US007654386B2

(12) United States Patent
Dall'omo et al.

(10) Patent No.: US 7,654,386 B2
(45) Date of Patent: Feb. 2, 2010

(54) MACHINE FOR WRAPPING BUNDLES OF ROLL PRODUCTS

(75) Inventors: Davide Dall'omo, Bologna (IT); Christian Zagnoni, Calcara Di Crespellano (IT)

(73) Assignee: Tissue Machinery Company S.p.A., Cardiano Di Granarolo (IT)

( * ) Notice: Subject to any disclaimer, the term of this patent is extended or adjusted under 35 U.S.C. 154(b) by 0 days.

(21) Appl. No.: 11/972,320

(22) Filed: Jan. 10, 2008

(65) Prior Publication Data

US 2008/0229709 A1 Sep. 25, 2008

(30) Foreign Application Priority Data

Jan. 12, 2007 (IT) ..... BO2007A0013

(51) Int. Cl.
*B65G 47/34* (2006.01)

(52) U.S. Cl. ..... 198/803.13; 53/228

(58) Field of Classification Search ..... 198/803.1, 198/803.13, 867.1; 53/228, 438, 504, 531; 414/796.7, 796.8
See application file for complete search history.

(56) References Cited

U.S. PATENT DOCUMENTS 1,461,746 A * 7/1923 Augustine ..... 198/803.13
4,041,822 A * 8/1977 Gabel ..... 83/409.2
4,679,379 A 7/1987 Cassoli
5,038,549 A * 8/1991 Nordstrom ..... 414/794.9
5,331,788 A * 7/1994 Cinotti ..... 53/228
6,067,780 A * 5/2000 Gentili et al. ..... 53/504
6,308,497 B1 10/2001 Cassoli
2002/0059784 A1 5/2002 Gamberini

FOREIGN PATENT DOCUMENTS

DE 198 60 018 A1 7/1999
EP 0 995 682 A 4/2002

* cited by examiner

*Primary Examiner*—James R Bidwell
(74) *Attorney, Agent, or Firm*—Pearne & Gordon LLP

(57) ABSTRACT

A machine (1) for wrapping bundles (2) of roll products (3), where the products (3) are grouped together in piles (4), comprises a bundle (2) forming line (6), equipped with a chain conveyor (7), and a product (3) feed line (12) that serves the forming line (6); the feed line (12) having an elevator (13) which is equipped with a product (3) supporting platform (14) and which is vertically mobile under the forming line (6) between a lowered position where it receives the products (3) and a raised position where it delivers the products (3) to the forming line (6); a screw mechanism, fixed to a fixed machine mounting structure and screwed on a lead nut placed inside a mounting frame, adjusts the position of the chain conveyor, the pair of pulleys and the pusher rods relative to the raised position of the product supporting platform.

5 Claims, 2 Drawing Sheets

MACHINE FOR WRAPPING BUNDLES OF ROLL PRODUCTS

BACKGROUND OF THE INVENTION

This invention relates to a machine for wrapping bundles of roll products, in particular, but without limiting the scope of the invention, roll products for household and/or bathroom use.

In the packaging industry, for certain consumer products such as rolls of paper for bathroom or household use, it is common practice to make multiple packages or bundles of products, where a sheet of plastic is wrapped around and holds together as one a certain predetermined number, or configuration, of products.

Within the bundle or configuration, the products are assembled in the form of vertical piles formed from horizontal layers neatly superposed and each in turn formed from a predetermined number of rolls placed side by side.

The formation of the bundles or the making up of the configuration is performed by special wrapping machines which basically comprise a bundle forming line where a plastic sheet is wrapped, folded and closed around the products; and a feed line which supplies the forming line with rolls which have been grouped together in suitable fashion.

The bundle forming line extends horizontally and comprises a power-driven chain conveyor.

The chain conveyor substantially comprises an endless flexible element or belt trained around a pair of pulleys to form an elongated, power-driven ring. The ring mounts a set of pusher rods distributed at regular intervals round the boundary of the ring and projecting transversally from the ring.

The feed line, on the other hand, extends vertically and lies under the forming line in the vicinity of one end of the forming line.

The feed line comprises a tube-like body with vertical walls and an elevator equipped with a horizontal platform that moves parallel to itself in a straight line inside, and between the top and bottom ends of, the tubular body.

The roll products are fed into the tubular body when the elevator platform is in the lowered position. Laterally confined by the walls of the tubular body and supported by the surface of the platform, the products are then made to move upwards in a straight line and gradually emerge from the tubular body intercepting as they do so a sheet of packaging material placed transversally along their path over the top of the tubular body.

When the products emerge from the tubular body, covered by the sheet of packaging material, they move under the continued lateral containing action applied to them previously until they reach a space located over the top of the tubular body and delimited by a pair of consecutive pusher rods which have in the meantime moved into line with the walls of the tubular body.

Once the bottom of the packaging sheet has been closed at the bottom of the product bundle, the conveyor ring slides lengthways along its boundary in such a way that the products are pushed off the elevator platform onto the forming line. Wrapping is then completed as the bundle advances along the forming line.

According to the current state of the art, the position of the chain conveyor relative to the elevator, or relative to the elevator platform, when the latter is at its topmost position, is fixed and is predetermined in such a way that the height of the space between consecutive pairs of pushers is such that the space can accommodate a maximum of two layers of superposed products.

In other terms, the wrapping machine can process groups of products arranged in a single layer or in two superposed layers.

The extension of the space lengthways along the forming line, on the other hand, can be adjusted by varying the pusher spacing according to the configuration required.

This can be done either manually by removing the pushers and refitting them in different positions or automatically by special adjustment mechanisms.

Whatever the case, the above mentioned machines permit the formation of single- or double-layer bundles whose configurations can be varied in the lengthwise direction along the forming line.

Wrapping machines of the kind described above therefore have the disadvantage of being limited to producing single- or double-layer packages whose configurations can be varied only in the lengthwise direction along the forming line.

SUMMARY OF THE INVENTION

This invention therefore has for an aim to overcome the above mentioned drawback by providing a bundle wrapping machine capable of being adjusted, even in height, to suit any packaging configuration; that is to say, a machine at least capable of producing multiple layer bundles of products comprising even more than two layers of products.

According to the invention, this aim is achieved by a machine whose technical characteristics may be easily inferred from the contents of the appended claims, especially claim 1, and also any of the claims that depend, either directly or indirectly, on claim 1.

BRIEF DESCRIPTION OF THE DRAWINGS

The advantages of the invention are apparent from the detailed description which follows, with reference to the accompanying drawings which illustrate a preferred embodiment of the invention provided merely by way of example without restricting the scope of the inventive concept, and in which.

DESCRIPTION OF THE PREFERRED EMBODIMENTS

Figure 1:
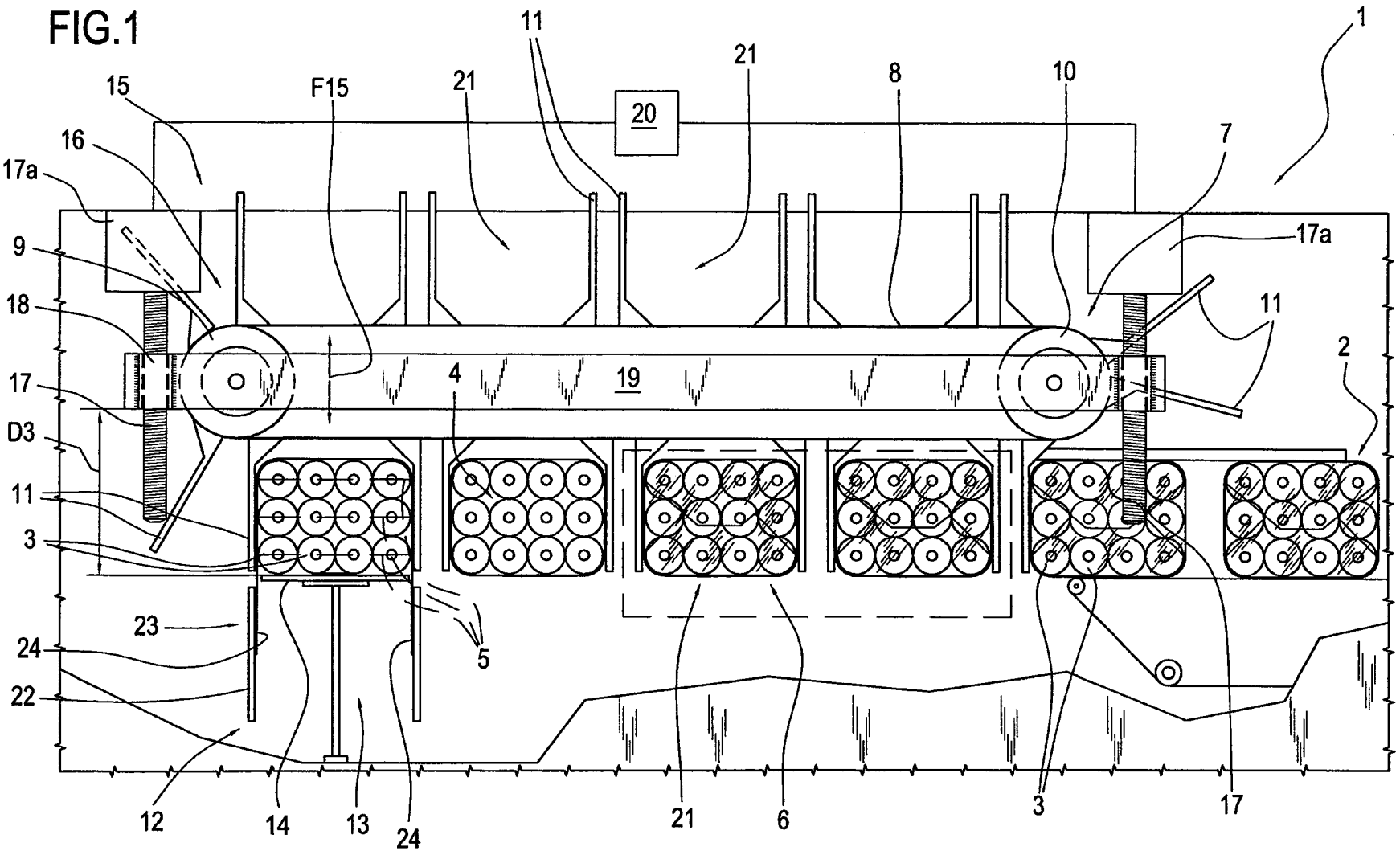
FIG. 1 illustrates a machine according to the invention represented in schematic form in a vertical plane observed from the side.

The numeral 1 in FIG. 1 denotes in its entirety a bundle wrapping machine for making bundles or configurations 2 of roll products 3, in particular rolls of paper for bathroom and/or household use, grouping them in piles 4 formed from flat horizontal layers 5 superposed neatly in a vertical direction.

The machine 1 essentially comprises a line 6 for forming the bundles 2 and a line 12 for feeding the products 3 to be included in each bundle 2 to make up a configuration.

The bundle 2 forming line 6 is equipped with a power-driven chain conveyor 7 where an endless flexible element 8 is trained around a pair of pulleys 9 and 10 of which at least one is power driven.

The flexible element 8 forms a horizontally elongated ring and mounts pusher rods 11 projecting in a direction transversal to the flexible element 8.

The pushers 11 are distributed along the boundary of the flexible element 8 at predetermined regular intervals and extend lengthways in such a way as to form spaces 21 between each consecutive pair of them for accommodating the piles 4 along the forming line 6.

Figure 3:
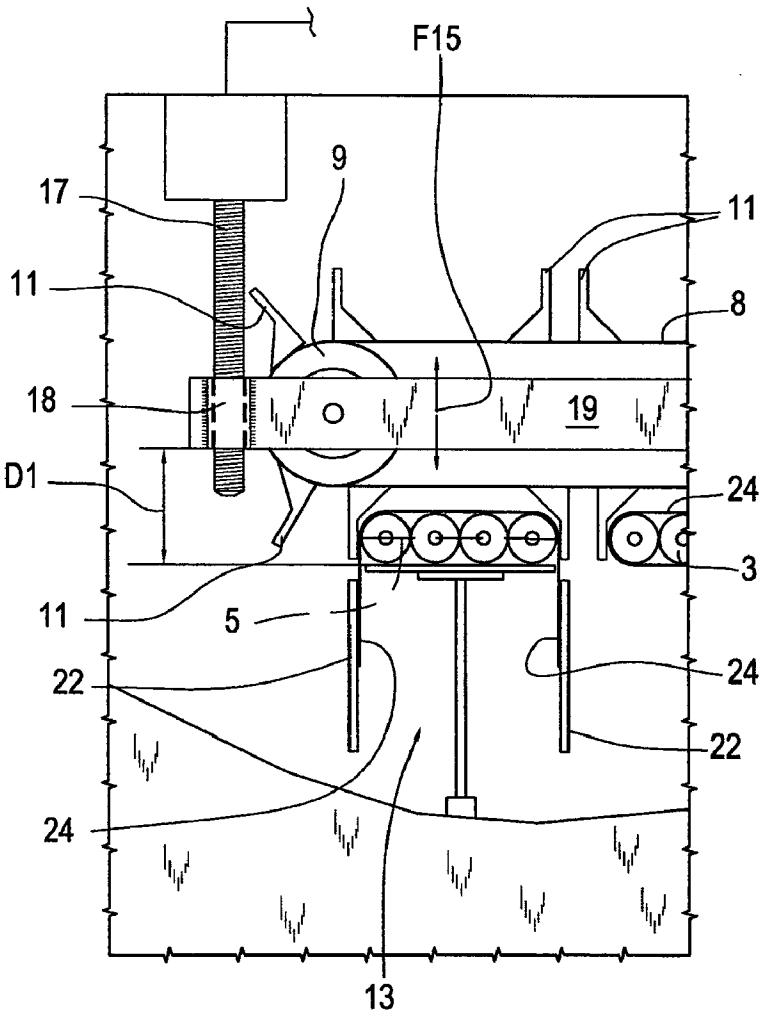
FIGS. 2 and 3 are side views illustrating two different operating configurations that can be adopted by the machine of FIG. 1.
Figure 2:
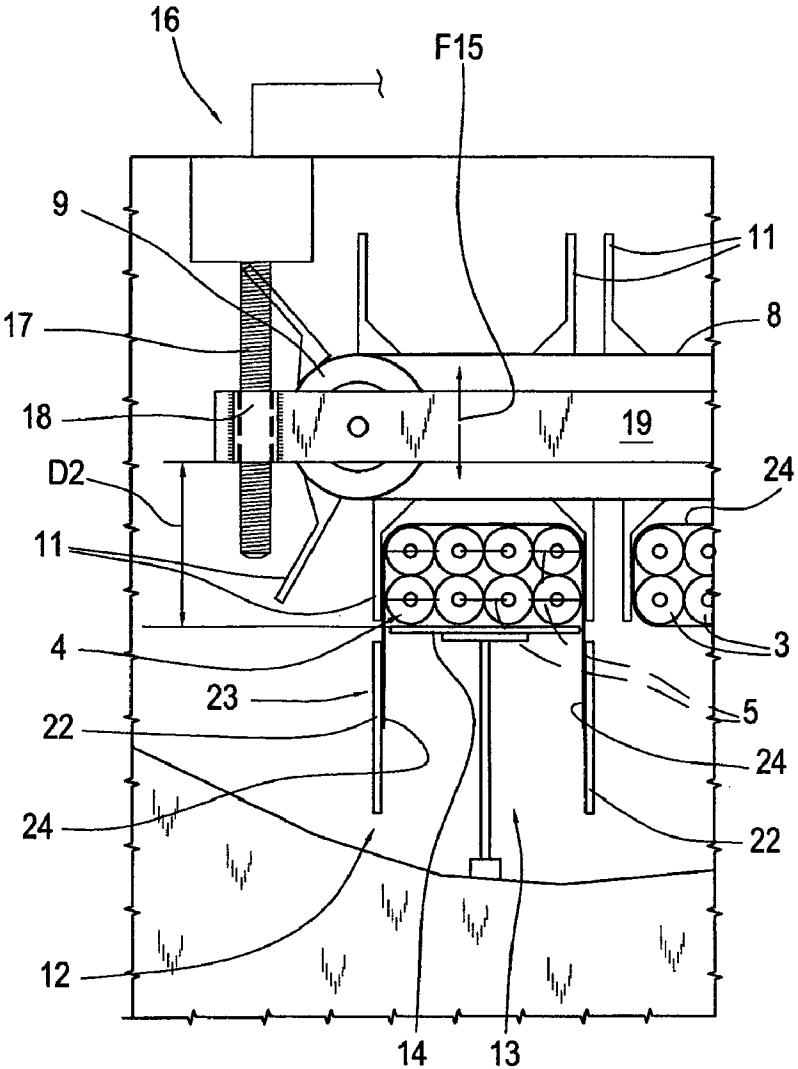

The product 3 feed line 12 (of known type), serving the forming line 6, has an elevator 13 which is equipped with a product 3 supporting platform 14 and which is vertically mobile under one end of the forming line 6 between two limit positions, namely a lowered position where it is away from the forming line 6, and a raised position where it is close to the forming line 6; the latter being the position of the machine 1 illustrated in FIGS. 1 to 3.

At the lowered position, the elevator 13 receives the roll products 3 in a manner well known to experts in the trade. Once grouped together on the supporting platform 14, the products are lifted towards the top of a tubular guide body 23 through the latter's vertical walls 22 to form the bundle 2.

The raised position is reached by the elevator 13 platform 14 when the top of the pile 4 intercepts a sheet 24 of packaging material.

At the raised position, the roll products 3, suitably grouped together and already partly wrapped by the sheet 24, are delivered to the forming line 6, again in a manner well known to experts in the trade.

The machine 1 further comprises adjustment means, generically labeled 15 in their entirety, designed to adjust the position of the forming line 6 in height relative to the raised position of the product 3 supporting platform 14 in order to permit the production, preferably but not restrictively, of bundles with multiple layers 5 and, in particular, of bundles 2 with a number layers 5 at least equal to or greater than two.

As illustrated in FIG. 3, this may also be used to speed up the production of bundles having a single layer 5.

Preferably, the fixed position is determined with reference to the raised position of the supporting platform 14; thus, it is the forming line 6 (that is to say, the assembly made up of the power-driven conveyor 7 comprised of the flexible element 8, the pair of pulleys 9 and 10 and the pusher rods 11 mounted on a frame 19) which, being mobile in height (see arrows F15) relative to said raised position, can be adjusted as required in each case according to the packaging configuration desired for the groups of products 3 constituting the different types of bundle 2.

The adjustment means 15 may be embodied in different forms.

In one preferred embodiment, they comprise a lead nut 18 and screw 17 mechanism 16 interposed between the forming line 6, comprising a frame 19 for mounting the forming line 6 itself and to which the mechanism 16 is screwed, and a fixed machine mounting structure 17*a* (illustrated schematically in the drawings since it is of known type), the raised position of the supporting platform 14 also being fixed and invariable relative to said structure 17*a*.

The mechanism 16 may be actuated manually or it may be power-driven by respective drive means 20 not only to make adjustment quicker and easier but also to facilitate management machine 1 changeover procedures from one bundle 2 configuration to another.

The height adjustment of the machine 1 can be performed by changing the adjustment stroke by predetermined multiples of the height of a product 3 according to the number of product 3 layers 5 required (as clearly shown in FIGS. 1, 2 and 3, where different adjustment strokes are labeled D3, D2, D1).

In the example embodiment of the machine 1 shown in FIG. 1, the product 3 group configuration comprises piles 4 formed from three product layers 5. As stated above, however, it will be understood that the capability of the machine 1 according to the invention covers many different product 3 group packaging configurations, ranging from packages with single or double layer 5, as shown in FIGS. 2 and 3, to multiple layer packages where the number of layers 5 is limited solely by the maximum length of the pusher rods 11 used, which may be changed when necessary according to the number of layers 5 to be handled.

The invention described is susceptible of industrial application and may be modified and adapted in several ways without thereby departing from the scope of the inventive concept. Moreover, all the details of the invention may be substituted by technically equivalent elements.

What is claimed is:

1. A machine for wrapping bundles of roll products, where the products are grouped together in piles formed from superposed layers of products, said machine comprising at least:

a bundle forming line equipped with a chain conveyor where an endless flexible element trained around a pair of pulleys to form a horizontally elongated ring mounting projecting pushers; and a product feed line, serving the forming line and having an elevator which is equipped with a product supporting platform and which is vertically mobile under the forming line at least between a lowered position where it receives the products and a raised position where it delivers the products to the forming line, a screw mechanism fixed to a fixed machine mounting structure and screwed on a lead nut placed inside a mounting frame onto which the chain conveyor comprised of the endless flexible element, the pair of pulleys and the pusher rods are mounted; the screw mechanism screwing into said lead nut for adjusting the position of the chain conveyor comprised of the endless flexible element, the pair of pulleys and the pusher rods relative to the raised position of the product supporting platform.

2. The machine according to claim 1, wherein the raised position of the supporting platform is fixed, the forming line being mobile so it can be adjusted relative to said fixed position of the supporting platform.

3. The machine according to claim 1, wherein the screw mechanism is power-driven by respective drive means.

4. The machine according to claim 1, wherein position of the chain conveyor comprised of the endless flexible element, the pair of pulleys and the pusher rods relative to the raised position of the product supporting platform is performed according to multiples of height of a product.

5. The machine according to claim 4, wherein said multiples of height of products corresponds to three or more superposed layers of the products.

* * * * *